United States Patent [19]

Monot

[11] 4,000,582

[45] Jan. 4, 1977

[54] OBLIQUE-DISPLACEMENT SLIDING DOOR

[75] Inventor: Bernard Monot, Aubervilliers, France

[73] Assignee: Faiveley S.A., Saint-Ouen, France

[22] Filed: July 7, 1975

[21] Appl. No.: 593,457

[30] Foreign Application Priority Data

July 18, 1974 France ..... 74.24987

[52] U.S. Cl. ..... 49/218; 49/362

[51] Int. Cl.[2] ..... E05D 15/10

[58] Field of Search ..... 49/210–225, 49/362; 74/57

[56] References Cited

UNITED STATES PATENTS 1,195,665 8/1916 Etter ..... 74/57

FOREIGN PATENTS OR APPLICATIONS 2,133,309 11/1972 France ..... 49/225

*Primary Examiner*—Kenneth Downey

*Attorney, Agent, or Firm*—Young & Thompson

[57] ABSTRACT

The door comprises at least one sliding leaf which is capable of engagement and disengagement transversely within the door-frame, two separate toothed racks being mounted on each leaf and each associated with a pinion supported by a guided carriage, the two pinions being coupled by means of a coordinating shaft. Operating means comprising a motor and a mechanism for driving the pinions are rigidly fixed to at least one of two crank-arms, each crank-arm being pivotally connected to a carriage and to the door-frame.

6 Claims, 5 Drawing Figures

F
X1X2

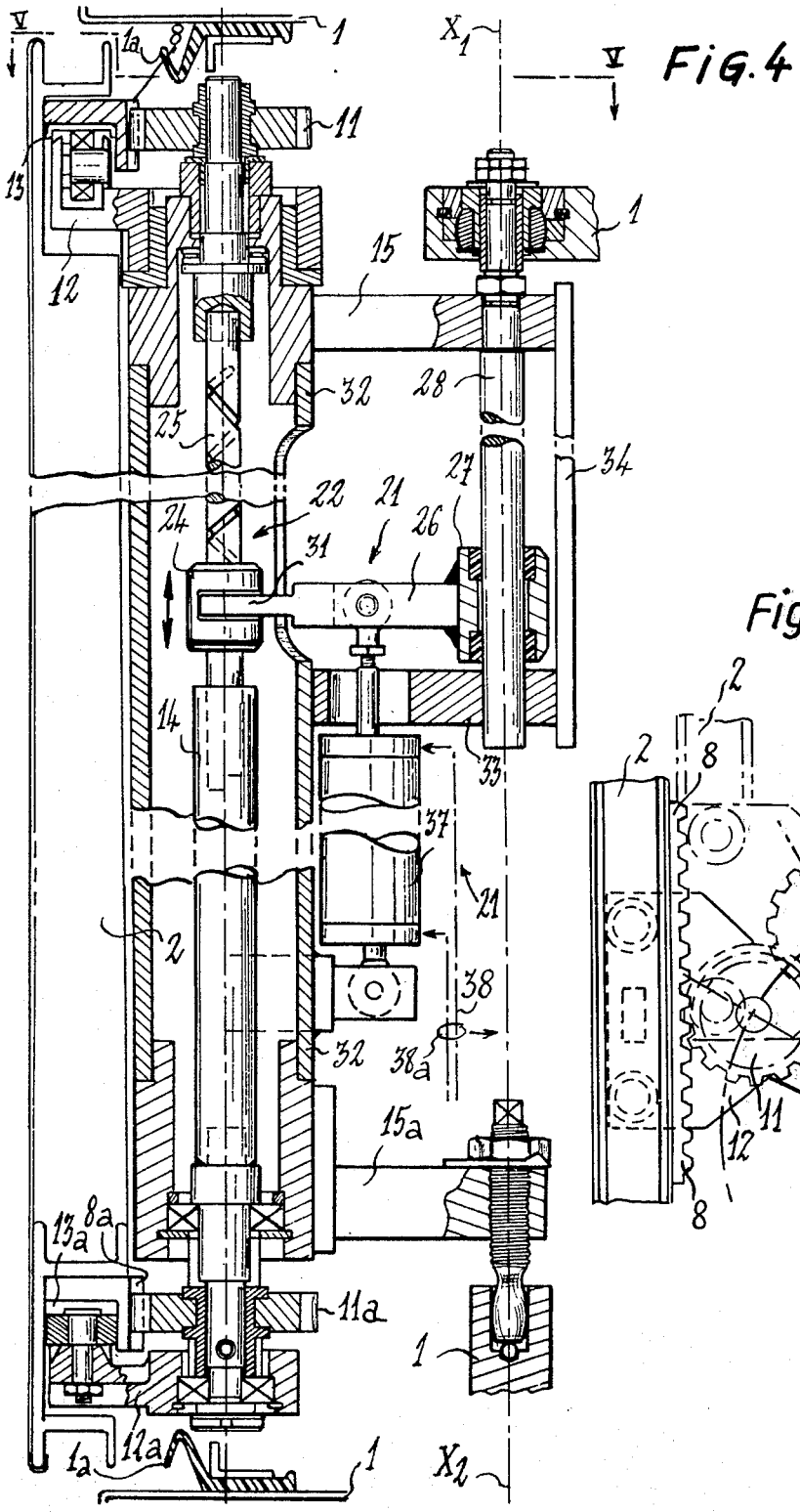
Fig. 4
Fig. 5
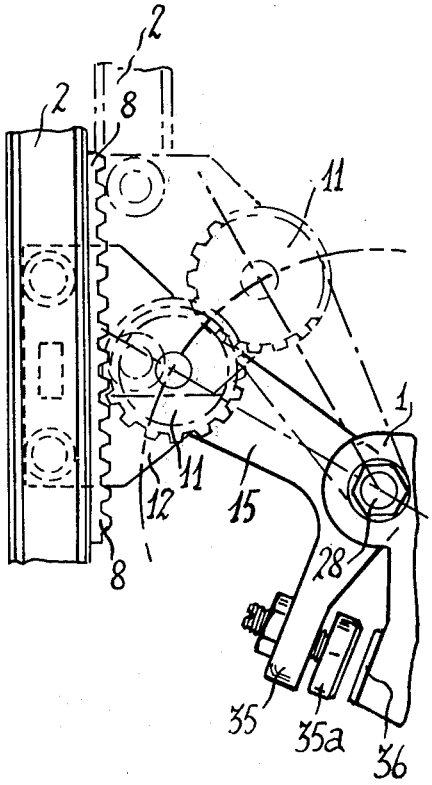

OBLIQUE-DISPLACEMENT SLIDING DOOR

This invention relates to an oblique-displacement sliding door of the type comprising a stationary frame and at least one sliding leaf associated with guiding means for engaging the leaf transversely within the frame in the closed position and disengaging said leaf at the beginning of the opening movement; operating means are additionally provided for producing action on the leaf in the direction of sliding motion.

Doors of this type are of special interest, especially in the case of vehicles for public transportation or elevator cabins. The result thereby achieved is to dispense with the need for the double-wall structure which had hitherto been made necessary for the passage of ordinary sliding door-leaves and the leaf can be inserted transversely within a stationary frame having the same thickness as said leaf.

In accordance with safety regulations governing the transportation of persons, it must be possible for doors of this type to be readily operated by hand in the event of incident when any failure occurs in the normal operating means. It is therefore necessary to ensure that the operation of such doors is both smooth and reversible.

In some known forms of construction, use is made of two motors, namely a main motor which carries out the movement of translation of the leaf at the beginning of the opening movement in order to disengage said leaf from the frame and at the end of the closing movement in order to re-engage said leaf. This system of two motors constituted by pneumatic jacks, for example, is both costly and cumbersome. It is in fact important to ensure that as much clearance as possible should be provided in the vicinity of the door.

In one form of construction proposed by the present Applicant and described in his French Pat. No. 2,133,309, the oblique displacement of the leaf is obtained by means of a single jack-motor associated with a leaf-stabilizing device. This device is provided on the leaf with two toothed racks in spaced relation and parallel to the direction of sliding motion, said racks being each associated with a pinion supported by a carriage, said carriage being retained by a guide which is parallel to the rack. The leaf is connected to the frame by means of two articulated crank-arms, one end of each crank-arm being connected to a carriage and the other end being connected to the frame. Said crank-arms are substantially transverse to the leaf in the open position and inclined at a very sharp angle with respect to the orientation aforementioned in the closed position. This assembly makes it possible to carry out the oblique motion of the leaf in both directions by virtue of a set of actions and reactions between the jack-motor, the crank-arms, the leaf and the guiding means carried by the door-frame.

However, the form of construction mentioned above does not make it possible to satisfy certain conditions of overall size and convenience of access of the do0r-control mechanism in several cases of installation.

Especially in the case of a door having a single leaf operated in translational motion by means of a pneumatic jack, it is often important to ensure that the overall dimensions of the mechanism do not exceed the width of the leaf. In the case of doors which are intended to be employed in public transportation vehicles and to which the invention is primarily applicable, the installation of such doors can be carried out entirely at one end of the vehicle without any reserve space or projection with respect to the end wall of the vehicle body.

The object of the invention is primarily to solve the difficulty which has just been mentioned.

The invention is directed to an oblique-displacement sliding door comprising a stationary frame and at least one sliding leaf associated with guiding means for engaging the leaf transversely within the door-frame in the position of closure and for disengaging said leaf from said frame in the opposite direction at the commencement of the opening movement, operating means being provided for producing action on the leaf in the direction of sliding motion; the door additionally comprises a leaf-stabilizing system in which provision is made on the leaf for two separate toothed racks which are parallel to the direction of sliding motion and each associated with a pinion supported by a carriage retained by a guide which is parallel to said toothed rack; the two pinions aforementioned are coupled by means of a coordinating shaft which is transverse to the guides; this known device is completed by two articulated crank-arms each having one end connected to a carriage and the other end connected to the door-frame, the axes of the two articulations of the crank-arms on the frame being in substantially coincident and parallel relation to the coordinating shaft; the operating means comprise a motor and a mechanism for driving the pinions of the leaf-stabilizing system in rotation.

In accordance with the invention, the door of the type aforementioned is distinguished by the fact that the motor aforementioned and the drive mechanism are rigidly fixed to at least one of the crank-arms which are pivotally mounted on the frame.

As will be explained hereinafter, this arrangement makes it possible to construct a door in which the motor and the drive mechanism do not exceed the width of the leaf while permitting easy assembly and adjustment and offering a high degree of endurance. These advantages are of particular importance in public transportation vehicles to which the invention is especially directed. Aside from the very strict contingencies of overall dimensions, the doors of vehicles of this type are in fact subjected to very frequent operations.

In a preferred embodiment of the invention, the motor is a linear motor associated with a nut in cooperating relation with a threaded portion of the coordinating shaft which comprises a reversible-action thread. Provision can thus be made for a simple and rugged mechanism of small overall size, for example by employing a motor consisting of a pneumatic jack which is parallel to the coordinating shaft. It is thus possible to accommodate in a convenient manner devices and component parts having relatively large dimensions and exhibiting a high degree of endurance which is favorable to smoothness of operation, especially by hand, without exceeding the width of the leaf.

In one advantageous embodiment, the motor aforementioned actuates a cross-member which connects the nut to a slide-block mounted on a guiding shaft having the same axis as the articulation of the crank-arms. If the play of the slide-block on the guiding shaft is of small value and if the cross-member is rigidly fixed to the slide-block, the cross-member is maintained in a fixed direction which is preferably perpendicular to said slide-block. This improves the smoothness and accuracy of operation of the mechanism, especially for emergency hand operation.

Further properties and advantages of the invention will result from the following description of a preferred embodiment of the invention which is presented solely by way of example and not in any limiting sense, reference being had to the accompanying drawings, wherein:

FIG. 1 is a schematic overhead plan view of the top portion of a door in accordance with the invention in the position of closure of the leaf;

FIG. 2 which is similar to FIG. 1 shows the leaf at the commencement of opening;

FIG. 3 which is similar to FIGS. 1 and 2 shows the leaf which is fully withdrawn from the door-frame;

FIG. 4 is a sectional view in elevation showing an industrial construction of a door mechanism which is similar to that of the diagrams of FIGS. 1 to 3;

FIG. 5 is a sectional view of FIG. 4 taken along line V—V.

Figures 1, 2, 3:
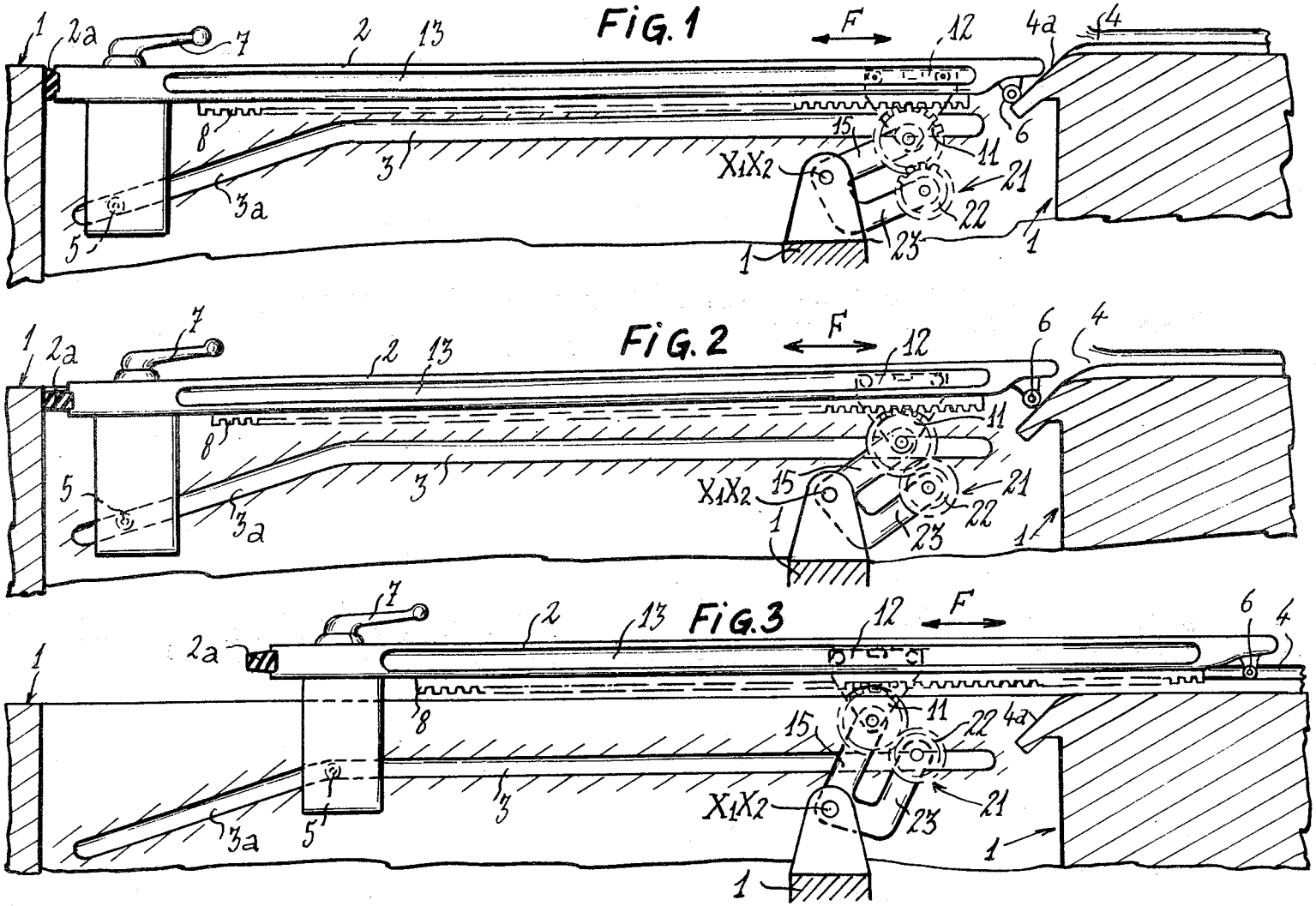

In the embodiment which is represented schematically in FIGS. 1 to 3, the oblique-displacement sliding door comprises a stationary frame 1 and a sliding leaf 2 associated with guiding means attached to the door-frame 1 so as to engage the leaf transversely in the frame in the closed position and to disengage said leaf in the opposite direction at the beginning of opening.

In the closed position, the seating of the leaf 2 within the door-frame 1 is defined by a peripheral seal 1*a* (as shown in FIG. 4). This end-of-travel adjustment is completed by an edge seal 2*a* (FIGS 1 to 3) which is intended to be compressed against an upright member of the frame 1 or against the edge of an opposite leaf at the end of the movement of closure.

The guiding means attached to the frame comprise guides 3, 4 (as shown in FIGS. 1 to 3) each having an oblique end portion 3*a*, 4*a* in order to carry out the transverse movement of the leaf 2, said leaf being accordingly adapted to carry guide rollers 5, 6 which are associated respectively with said guides.

Operating means are provided for producing action on the leaf in both directions of sliding motion as represented in the figures by the double arrow F. Said operating means comprise a motor (described hereinafter) and a handle 7 associated with a lock (not shown) for carrying out emergency operation of the leaf by hand in the event of failure of the motor.

In order to maintain the leaf 2 in a constant direction with respect to the guides 3, 4 and to prevent any resistance to sliding motion, the leaf 2 is connected to the door-frame 1 by means of a stabilizing system which is provided on the leaf with two toothed racks such as the rack 8 which are in spaced relation and parallel to the direction of sliding motion (arrow F), each rack being associated with a pinion 11 supported by a carriage 12, said carriage being retained by a guide slot 13 which is parallel to the toothed rack 8. The pinions 11, 11*a* (shown in FIG. 4) are coupled by means of a coordinating shaft 14 located transversely to the guide slots 13, 13*a*.

Two articulated crank-arms 15 15*a* each have one extremity connected to a carriage 12, 12*a* in a manner which will be explained in detail hereinafter whilst the other extremity is connected to the door-frame 1. The axes of the two pins on which the two crank-arms 15, 15*a* are mounted on the frame 1 coincide along a common axis X1–X2 which is parallel to the coordinating shaft 14.

The door of the aforementioned type is provided with operating means comprising a motor 21 associated with a movable mechanism 22 so as to drive in roatational motion the pinions 11, 11*a* of the system for stabilizing the leaf 2.

In accordance with the invention, a stationary portion 23 of the motor 21 is rotationally coupled to the crank-arms 15, 15*a* and pivotally mounted on the door-frame 1 along the axis X1–X2 of pivotal motion of the crank-arms 15, 15*a* (as shown in FIG. 1).

In the industrial embodiment of the invention which is illustrated in FIGS. 4 and 5, the motor 21 is a linear motor associated with a nut 24 which cooperates with a threaded portion 25 of the coordinating shaft 14. Said threaded porition comprises a reversible-action screw-thread having a caliber of 15 to 30 millimeters, for example, and a pitch of the order of 60 to 120 mm per revolution in order to ensure easy operation in both directions of displacement of the leaf 2 either by means of the motor or by hand as will be explained hereinafter.

The linear motor 21 is mounted between the coordinating shaft 14 and the axis X1–X2 on which the crank-arms 15, 15*a* are pivoted to the frame 1. The motor 21 imparts translational motion in the direction of the axis X1–X2 to a sliding cross-member 26 which connects the nut 24 to a slide-block 27 mounted on a guiding shaft 28 having the same axis X1–X2 as the axis of pivotal motion of the crank-arms 15, 15*a* on the door-frame 1.

The coupling cross-member 26 has a forked member 31, the two arms of which cooperate with two opposite faces of the nut 24 on each side of the threaded portion 25 of the coordinating shaft 14. The forked member 31 is mounted on the nut 24 in such a manner as to prevent this latter from rotating and moving in the axial direction with respect to said forked member 31 in both directions of operation of the mechanism. The cross-member 26 is thus rotationally coupled to the crank-arms 15, 15*a* with respect to the axis X1–X2 on which these latter are pivotally mounted on the door-frame.

The slide-block 27 comprises a tubular body which is adjusted on the guiding shaft 28 with very small play by virtue of two spaced annular seatings formed for example of bronze or of hard and self-lubricating plastic material. The coupling cross-member 26 is rigidly mounted on the body of the slide-block 27, for example by means of welded reinforcements which maintain the cross-member at right angles to the axis X1–X2.

The crank-arms 15, 15*a* (shown in FIG. 4) are rigidly fixed to a tube 32 which is coaxial with the coordinating shaft 14 and in which this latter is capable of displacement in pivotal motion. The tube 32 is provided with a slot directed along its axis for the passage and free axial displacement of the cross-member 26. The crank-arms 15, 15*a* are welded to strengthening sleeves which are engaged within the extremities of the tube 32 and keyed rotationally by means of splines, for example. There is thus formed a rigid assembly which maintains the crank-arms 15, 15*a* in parallel relation and ensures that the axis X1–X2 of the crank-arm extremities is maintained parallel with the coordinating shaft 14.

The assembly aforementioned is reinforced by means of a stationary cross-member 33 which is parallel to the crank-arms 15, -*a* and connects the lower end of the guiding shaft 28 to the tube 32. A strengthening member 34 which is parallel to the tube 32 and welded to the extremities of the crank-arm 15 and of the stationary cross-member 33 serves to constitute a rigid rectangular structure for maintaining both ends of the guiding shaft 28 along the axis X1–X2.

The mechanical strength of the rectangular structure aforementioned makes it possible in particular to withstand the bending stresses applied to the crank-arm 15 by a lateral retaining arm 35 fitted with an adjustable stop 35*a* of hard rubber, for example. A stationary stop 36 located opposite to said adjustable stop and attached to the door-frame 1 serves to limit the range of displacement of the crank-arms 15, 15*a* in the open position of the leaf 2 as explained hereinafter.

The mechanism aforementioned is actuated by means of a double-acting pneumatic jack 37 mounted parallel to the tube 32 to which the jack body is fixed. Said jack is supplied with compressed air through pipes 38 which are fitted in known manner with control electrovalves (not shown in the drawings) and a double valve 38*a* for establishing a communication with the atmosphere in order to permit emergency hand operation of the leaf 2 as will be explained hereinafter. The operating rod of the jack 37 is connected to the sliding cross-member 26 substantially at the mid-point of this latter.

The operation of the door which has just been described will now be explained.

When the operating rod of the jack 37 (shown in FIG. 4) carries out a movement of displacement either in one direction or in the other, said operating rod is accompanied by the cross-member 26 and the nut 24 which is associated therewith. The translational motion of the nut 24 which is secured against rotational motion by the forked member 31 causes the threaded portion 25 (having reversible action) of the coordinating shaft 14 to rotate, thus applying a driving torque to each of the two pinions 11, 11*a* of the system for stabilizing the leaf 2. Said leaf is accordingly driven in the direction of sliding motion by means of the toothed racks 8, 8*a* which are associated with the pinions 11, 11*a*, said pinions being retained by the carriages 12, 12*a* and said carriages being connected to the crank-arms 15, 15*a* which are pivotally mounted on the door-frame 1 along the axis X1–X2.

For the sake of enhanced clarity, reference will now be made to the diagrams of FIGS. 1 to 3.

At the beginning of the opening travel (as shown in FIGS. 1 and 2), the torque applied by the moving portion 22 of the motor 21 to the pinion 11 of the stabilizing system produces a reaction torque in the opposite direction on the stationary portion 23 of the motor and on the crank-arm 15 which is pivotally mounted on the door-frame 1 along the axis X1–X2. The reaction torque thus applied to the crank-arm 15 facilitates the orientation of this latter in the direction corresponding to disengagement of the leaf which is also subjected to the action of the oblique portions 3*a*, 4*a* of the guides 3, 4 which are associated with the rollers 5, 6. In the position of full withdrawal of the leaf (as shown in FIG. 3), the crank-arm 15 is substantially transverse to the leaf whereas said crank-arm is in a very oblique position with respect to this latter in the closed position (as shown in FIG. 1).

In the opposite direction and in the case of closure of the leaf, the motor 21 drives the pinions 11 of the stabilizing system in rotation and first initiates the rectilineal displacement of the guiding rollers 5, 6 of the leaf 2 within the straight portion of the guides 3, 4. When the rollers reach the oblique portions 3*a*, 4*a* of the guides aforementioned (as shown in FIG. 2), the reaction torque of the stationary portion 23 which is pivotally mounted on the door-frame 1 along the axis X1–X2 facilitates the orientation of the crank-arm 15 in the direction corresponding to transverse engagement of the leaf 2 in the door-frame 1. At the end of travel (shown in FIG. 1), the compression of the elastic seal 2*a* of the front edge of the leaf 2 limits the travel of the leaf in the direction of sliding motion (arrow F). At the same time, the reaction torque applied to the crank-arm 15 tends to increase the obliquity of this latter, thus facilitating the engagement within the door-frame 1 of the rear edge of the leaf which is adjacent to the guiding roller 6. The transverse motion of the leaf 2 in the direction of closure is limited by the peripheral seal 1*a* of the door-frame (as shown in FIG.4).

As long as the torque applied by the motor 21 to the pinion 11 in the direction of closure (FIG. 1) is maintained, the reaction torque of the crank-arm 15 opposes any effort exerted on the leaf 2 in the direction of opening, for example by manual operation of the handle 7. The torque exerted by the motor 21 and the obliquity of the crank-arm 15 in the closed position of the leaf 2 are intended to afford resistance for example to a force of at least 25 kilograms in the direction of opening of the leaf, this force being sufficient to prevent any accidental or untimely operation without thereby involving any risk of a major accident condition on the side corresponding to the edge seal 2*a*. Similarly, the reaction torque exerted by the crank-arm 15 opposes any transverse effort exerted on the leaf 2 in the direction of disengagement of this latter, in particular in the vicinity of the rear edge which is located in proximity to the roller 6.

The operation of the device shown in FIGS. 4 and 5 corresponds to an industrial form of construction of the door in accordance with the invention and is identical with the operation of the device which has just been described for the sake of enhanced clarity with reference to the diagrams of FIGS. 1 to 3. In the device of FIG. 4, the torque exerted by the nut 24 on the threaded portion 25 of the coordinating shaft 14 produces, as has been explained in the foregoing, a reaction torque on the sliding cross-member 26 which prevents rotational displacement of the nut 24. The aforementioned reaction torque which is transmitted to the tube 32 and to the crank-arms 15, 15*a* by the structure of the rectangular frame which is associated with the guiding shaft 28 facilitates the variation in obliquity of the crank-arms with respect to the plane of the leaf 2 for the purpose of operating and maintaining said leaf in the closed position (as shown in FIG. 1).

In order to carry out emergency hand-operation of the leaf 2, the pipes 38 (shown in FIG. 4) are put into communication with the atmosphere by means of the two-way valve 38*a*. When the leaf 2 is displaced by means of the handle 7, for example to the closed position shown in FIG. 1, the door lock (not shown in the drawings) is first unlocked. As a result of the reversible action of the threaded portion 25 of the coordinating shaft 24, the manual displacement of the leaf 2 is represented on the pinions 11 by a moderate resisting torque produced by the friction of the jack 37 and of the motion converter 24/25. Said resisting torque of the pinions 11, 11*a* results in a reaction torque on the extremities of the crank-arms 15, 15*a* which are connected to the tube 32, thus facilitating the orientation of said crank-arms in the desired direction of displacement of the leaf 2, in particular in the desired direction of transverse motion of the rear edge of said leaf which is adjacent to the roller 6 with respect to the door-frame 1.

By virtue of the adjustable stop 35*a* (shown in FIG. 5), the limit of the range of angular displacement of the crank-arms 15, 15*a* which are coupled together by means of the tube 32 can be adjusted according to requirements in the direction of opening of the leaf 2. The alignment of the guiding roller 6 within the external guide 4 (shown in FIG. 3) can thus be ensured in an accurate and durable manner. This makes it possible to reduce the reactions of the roller 6 within the guide 4 so as to improve the smoothness of sliding motion of the leaf 2, especially in the zone of transition between the oblique portion and the straight portion of the guide.

It is apparent that, for example in the industrial form of construction which is illustrated in FIGS. 4 and 5, the invention makes it possible to construct a rugged door mechanism which provides a long service life and very smooth operation. This mechanism is also easy to adjust by modifying the peripheral seal 1*a* (shown in FIG. 4), the front edge seal 2*a* and the position of the adjustable stop 35*a* (shown in FIG. 5).

Emergency hand-operation is also carried out both smoothly and easily, especially at the beginning of the opening movement of the leaf 2 for disengaging from the door-frame 1 the read edge which is close to the roller 6 or for re-engaging said edge within the door-frame at the end of the closing movement (FIG. 2) by slightly compressing the edge seal 2*a* and the peripheral seal 1*a* (shown in FIG. 5). It has in fact been noted that the resisting torque of the pinions 11 facilitates the variation in obliquity of the crank-arms 15 in the desired direction.

The mechanism provided by the invention does not exceed the width of the leaf 2 (as shown in FIGS. 1 to 3).

The invention is clearly not limited to the form of construction which has been described in the foregoing by way of example and many alternative forms can be contemplated without thereby departing either from the scope or the spirit of the invention.

From this it follows in particular that several alternative arrangements can be devised for the motor and the mechanism which are provided for actuating the pinions of the stabilizing system. For example, it is possible to employ a pneumatic or electric rotary motor associated with a suitable reduction-gear unit and with a declutching system for hand operation. Said motor can be mounted together with its mechanism on a crank-arm such as the crank-arm 15 of FIG. 4 or can alternatively be mounted on the tube 32.

The choice between the arrangements mentioned above will be dictated especially by considerations of overall size, ruggedness and simplicity for which preference has been given to the embodiment shown in FIG. 4 in a predetermined case.

I claim:

1. An oblique-displacement sliding door comprising a stationary frame and at least one sliding leaf associated with guiding means connected to the door-frame for engaging the leaf transversely within said frame in the position of closure and for disengaging said leaf from said frame in the opposite direction at the commencement of the opening movement, operating means being provided for producing action on the leaf in the direction of sliding motion, the door being additionally equipped with a leaf-stabilizing system in which provision is made on the leaf for two separate toothed racks which are parallel to the direction of sliding motion and each associated with a pinion supported by a carriage retained by a guide which is parallel to said toothed rack, the two pinions aforementioned being coupled by means of a coordinating shaft which is transverse to said guides, two pivotally mounted stabilizing crank-arms each having one end connected to a carriage and the other end connected to the door-frame, the axes on which the two crank-arms are pivoted to the frame being in substantially coincident and parallel relation to the coordinating shaft, the operating means being such as to comprising a reversible motor and a mechanism for driving the pinions of the leaf-stabilizing system in rotation, wherein the motor aforementioned and the drive mechanism are rigidly fixed to at least one of the two crank-arms which are pivotally mounted on said door-frame, said motor and drive mechanism being located on the same side as the stabilizing pinions with respect to the axis on which the crank-arms are privoted to the door-frame, thereby to apply opposite orientation torques on the crank-arms with the opposite directions of action of the motor, for the transverse engagement of the door-leaf and for maintaining the door-leaf in the door-frame in one direction of action of the motor, and for the disengagement of the door-leaf from the door frame in the other direction of action of the motor.

2. A door as defined in claim 1, in which said motor is a linear motor in substantially parallel relation to the coordinating shaft and associated with a nut in cooperating relation with a reversible-action threaded portion of said coordinating shaft, said linear motor being mounted between the coordinating shaft and the axis on which the crank-arms are pivoted to the door-frame, said motor actuating a sliding cross-member which connects the nut to a slide-block mounted on a guiding shaft having the same axis as the pivotal axis of said crank-arms.

3. A door as defined in claim 2, the two extremities of the guiding shaft being disposed in a rectangular structure pivotally mounted on the coordinating shaft of the crank -arms.

4. A door as defined in claim 2, the connecting cross-member comprising a forked member in which the two arms cooperate with opposite faces of said nut on each side of the coordinating shaft, said faces of said nut having means for retaining the arms of said forked member so as to prevent rotation of the nut and axial displacement of said nut with respect to said cross-member.

5. A door as defined in claim 2, the connecting cross-member being rigidly mounted on the slide-block and maintained by said slide-block in a transverse direction with respect to the coordinating shaft.

6. A door as defined in claim 1, and crank-arms coupled together by means of a tube which is coaxial with the coordinating shaft and in which said shaft is capable of rotating, the door-frame comprising at least one stop disposed opposite to a boss of a said crank-arm so as to limit the range of angular displacement of the crank-arms and the extent of transverse withdrawal of the leaf in the open position.

* * * * *